US006761672B1

(12) United States Patent
Williams

(10) Patent No.: US 6,761,672 B1
(45) Date of Patent: Jul. 13, 2004

(54) FITNESS GLIDER EXERCISE DEVICE

(76) Inventor: Nathan N Williams, 3711 SE. 9th Pl., Cape Coral, FL (US) 33904

( * ) Notice: Subject to any disclaimer, the term of this patent is extended or adjusted under 35 U.S.C. 154(b) by 72 days.

(21) Appl. No.: 09/915,880

(22) Filed: Jul. 26, 2001

(51) Int. Cl.[7] ..... A63B 21/068
(52) U.S. Cl. ..... 482/132; 482/127; 482/907
(58) Field of Search ..... 280/32, 32.6, 47.34, 280/47.39, 47.36, 47.371; 482/142, 135, 72, 101, 95, 96, 123, 130, 127, 132

(56) References Cited

U.S. PATENT DOCUMENTS 2,733,922 A * 2/1956 Diego ..... 482/96
4,274,647 A * 6/1981 Drake
5,066,005 A * 11/1991 Luecke ..... 482/135
5,299,826 A * 4/1994 Flowers ..... 280/47.371
5,433,685 A * 7/1995 Winslow et al. ..... 482/96
6,146,318 A * 11/2000 Kuo ..... 482/132
6,371,895 B1 * 4/2002 Endelman et al. ..... 482/135

* cited by examiner

*Primary Examiner*—Jerome W. Donnelly

(57) ABSTRACT

An exercise device guides the user during performance of a squatting exercise while the exercise device repetitively moves down and up any suitable vertically oriented surface, such as a wall. During performance of the squatting exercise the user rests against a back support surface. Rolling members provide for a smooth rolling contact between the exercise device and the wall during performance of the squatting exercise. A grip member, or members, positioned distal from the rolling members and in front of the user provides the user with ready and true control over the exercise device during the performance of the squatting exercise. The squatting exercise achieved using the exercise device strengthen or otherwise tone many muscle groups including the quadriceps, the knees, the hamstrings, the ankles, the glutenous maximus, the abdomen and the lower back.

4 Claims, 6 Drawing Sheets

FIG. 1
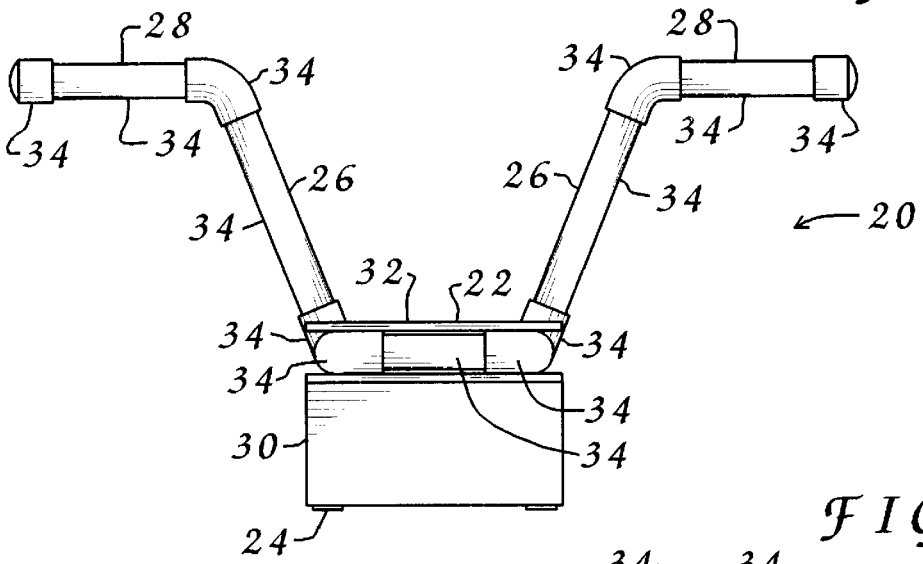
FIG. 2
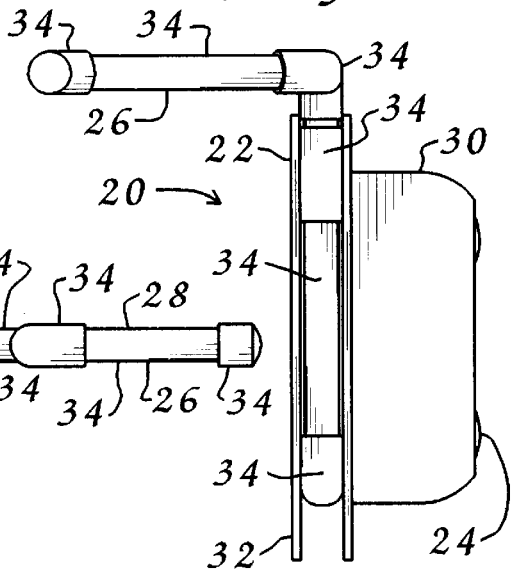
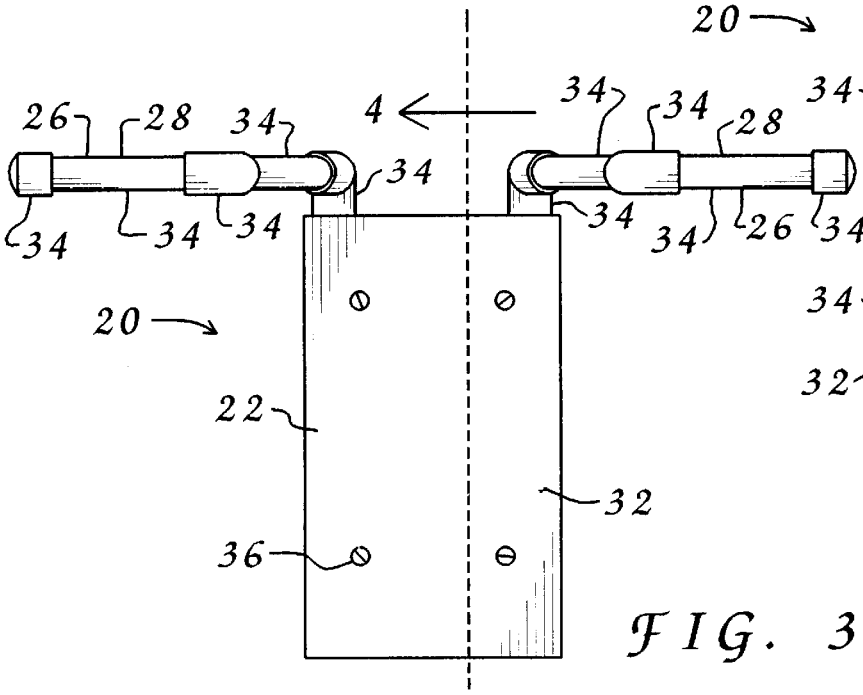
FIG. 3

FIG. 9a
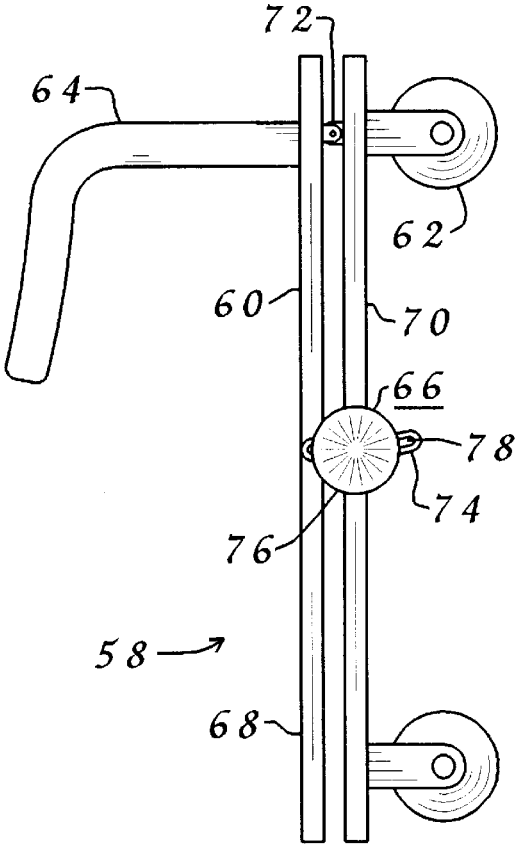
FIG. 9b
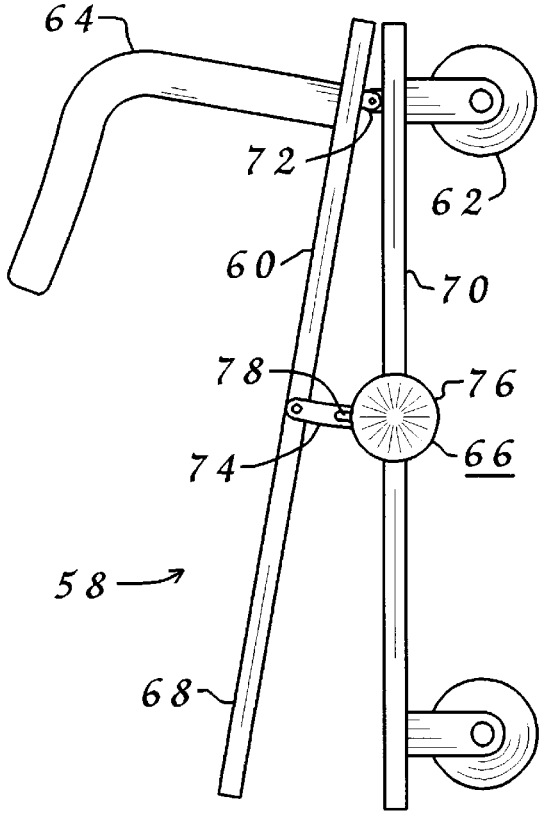
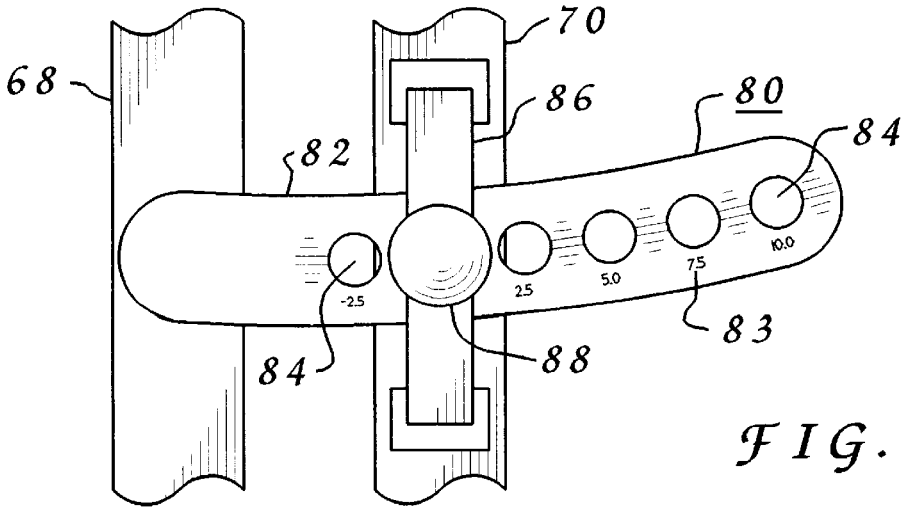
FIG. 10

FITNESS GLIDER EXERCISE DEVICE

BACKGROUND

1. Field of the Invention

Generally, the invention relates to exercise devices. More specifically, the invention relates to such exercise devices which support a user during performance of squatting exercises wherein the user's upper body moves up and down adjacent to a horizontal support surface while being stabilized by the horizontal support surface.

2. Description of the Prior Art

Numerous methods exist for people to exercise. Many of these methods may be enhanced by using exercise devices which perform some desired function. Such functions include isolation of select portions of the body, or select muscles or muscle groups, to target those areas for exercise, supporting the body in a desired orientation during the performance of the exercise wherein injuries are less likely to occur during the performance of the exercise and supporting the body wherein the exercise may be more readily performed for the comfort of the user.

Various devices are known to assist the person performing an exercise wherein the exercise is intended to strengthen, or otherwise target, the muscles of the legs and/or the muscles of the abdomen. Examples of these devices are known to place the user in various placement orientations relative to the respective device. Examples of these orientations include a position where the user is in a prone position facing upward and doing sit-ups or partial sit-ups, in a position where the user sits and moves portions of the body in various directions against tension from the device, in a position where the user leans over the device with some portion of the legs or feet contacting the floor or a portion of the device where the user receptively extends a portion of his or her body while being supported on moving portions of the device and in a position standing or leaning where the user repetitively squats while being at least partially supported or guided by portions of the device.

Many exercise devices are heavy and awkward to move and are intended to be used in a stationary position. Such devices typically have moving parts attached thereto which the user manipulates in one manner or another during performance of the exercise.

Many exercise devices are readily transportable by the user for convenient usage in various locations. Some devices of this class are also designed to move along some support surface during performance of the exercise. One example of such a device has wheels to engage the floor where the user leans over the device while on his or her knees or toes while gripping portions of the device. During performance of the exercise the user receptively leans outward while supported by the rolling device and contracts inward while continuing to be supported by the rolling device while flexing at the waist. Such exercises have proven to be beneficial for strengthening and toning the muscles of the abdomen, the arms, the chest and the back.

Various deficiencies exist with each of these types of exercise devices. Typically, the devices are intended, and specifically designed, to target a single area of the body of the person performing the respective exercise. Additionally, many of these devices place the user in an awkward orientation which is not routinely used by a person.

An ideal exercise for the upper legs, the knees, the lower legs, the ankles, the abdomen and the lower back is a simple squatting, or deep knee bend, exercise where the person repetitively move the upper body generally straight down and generally straight up. While this type of exercise is ideally suited to building lower body strength and exercising the abdomen many persons have difficulty in performing this type of exercise. A first reason for such difficulty resides in the effort required to maintain one's balance during performance and particularly during repetitive performance of the exercise. A second reason for such difficulty resides in a weakness in a portion of the body of the person performing the exercise and particularly in the knees of many persons. Such weakness may naturally occur or may result from various injuries including that resulting from high impact activities including running.

As can be seen various attempts have been made to provide devices to assist a person to perform exercises which will enhance the quality of life of the person. These attempts have been less efficient than desired. As such, it may be appreciated that there continues to be a need for a simple lightweight device which may assist people during performance of squatting exercises which eliminates the balance problem typically associated with deep knee bend type squatting exercises. The present invention substantially fulfills these needs.

SUMMARY

In view of the foregoing disadvantages inherent in the known types of exercise devices your applicant has devised a fitness glider exercise device which enables the user to safely accomplish many beneficial results at a slow controlled rate during short periods of exercise. The exercise device guides a user during performance of a squatting exercise. The performance of the squatting exercise occurring while the user vertically moves adjacent to, and supported by, a vertically oriented surface such as a wall. The exercise device remains stationary relative to the user while repetitively gliding down and up on the wall. The user's back makes contact with the exercise device during the performance of the squatting exercise. The exercise device has a plurality of rolling members, a back support surface and a gripping member. The rolling members are attached relative to the back support surface with the rolling members making contact with the wall to provide for the smooth rolling contact of the exercise device with the wall during the performance of the squatting exercise. The rolling members have a bearing plane which contacts the wall during the performance of the squatting exercise. The back support surface contacts and support the back of the user during the performance of the squatting exercise. The back support surface is positioned on the exercise device relative to the rolling members and have an average spacing distance from the bearing plane of the rolling members. The grip member is engaged by the user during the performance of the squatting exercise to provide the user with control over the exercise device. The grip member is positioned on the exercise device relative to the back support surface. The grip member has an average spacing distance from the bearing plane of the rolling members which is significantly greater than the average spacing distance of the back support surface from the bearing plane of the rolling members. During usage the exercise device is retained behind the user utilizing the grip member which is positioned in front of the user and backs up against the wall until the exercise device is firmly retained between the user and the wall. The feet of the user may then be positioned in various orientations depending upon the specific results desired. Then the user safely slides down the wall to a comfortable level and safely slides back up the wall. Such repetitive usage will work the major muscle groups of the lower body, the abdominal region and the lower back to strengthen, tone, shape and define those areas.

My invention resides not in any one of these features per se, but rather in the particular combinations of them herein disclosed and it is distinguished from the prior art in these particular combinations of these structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore a primary object of the present invention to provide for a simple lightweight fitness glider exercise device which may assist users during repetitive performance of squatting type exercises.

Other objects include;

a) to provide for an exercise device which may be utilized adjacent any flat vertical wall.

b) to provide for an exercise device which may be held by the user utilizing gripping members positioned in front of the user during movement against the wall and during performance of the squatting exercise.

c) to provide for mechanical resistance where a building resistance is created during one direction of travel to make movement in the opposing direction of travel easier.

d) to provide for a support of the back of the user generally parallel to the vertical surface upon which the exercise device travels during the performance of the squatting exercise.

e) to provide for a support of the back of the user at an angular offset relative to the vertical surface upon which the exercise device travels during the performance of the squatting exercise.

f) to provide for placement of the feet of the user at various orientations to provide for a targeting of various muscle groups during performance of the squatting exercise.

g) to provide for an aerobic type routine wherein overall fitness is enhanced.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated the preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein;

FIG. 1 is a bottom plan view of an exercise device.

FIG. 2 is a side elevational view of the exercise device shown in FIG. 1.

FIG. 3 is a front elevational view of the exercise device shown in FIG. 1 and FIG. 2.

FIG. 9*a* and FIG. 9*b* are side elevational views of yet another embodiment of an exercise device shown in alternative orientations.

FIG. 10 is an enlarged partial view of an offset securement device.

DESCRIPTION

Figure 4:
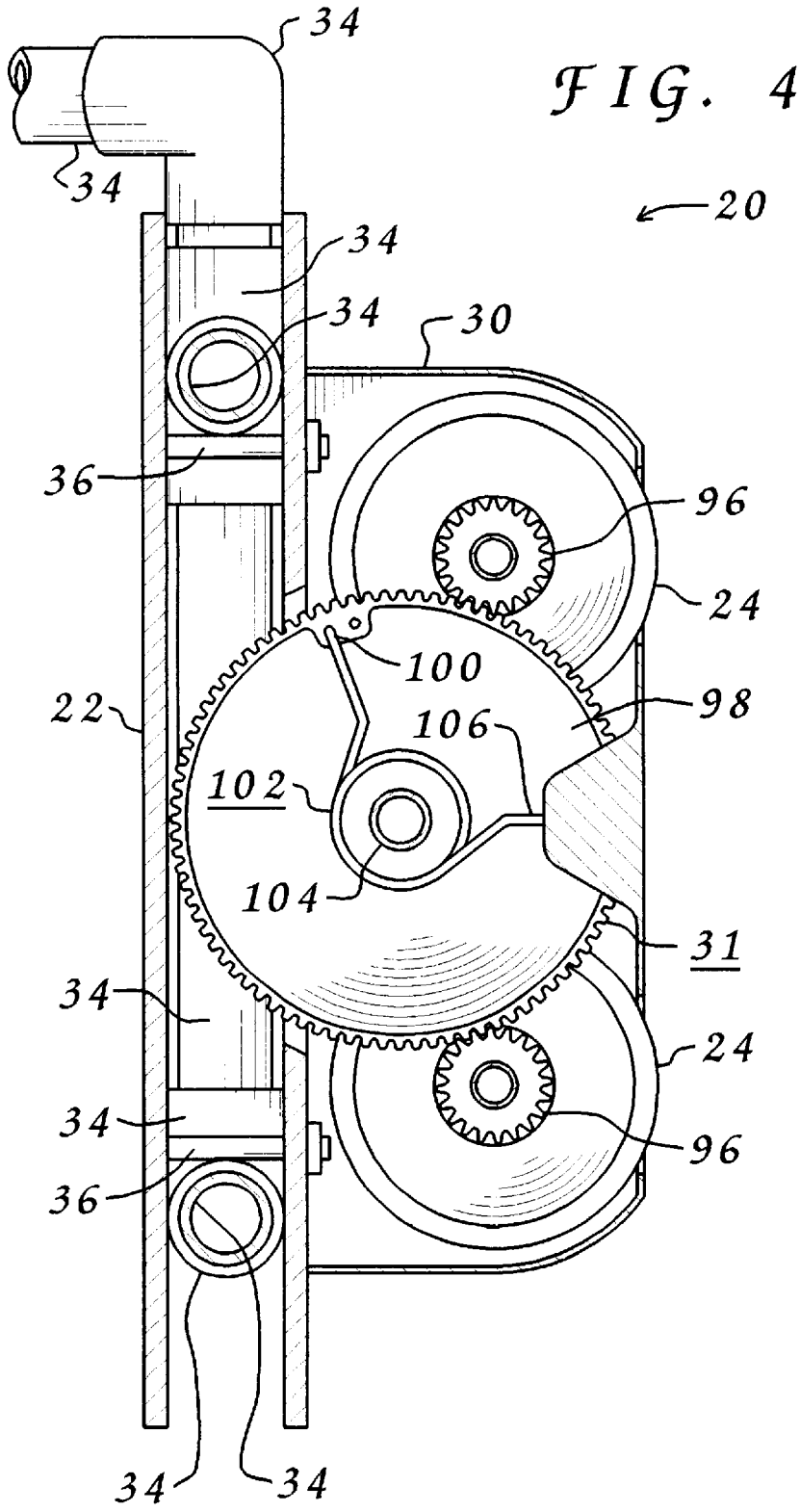
FIG. 4 is a sectional view as taken from the section line '4' shown in FIG. 3.
Figure 5:
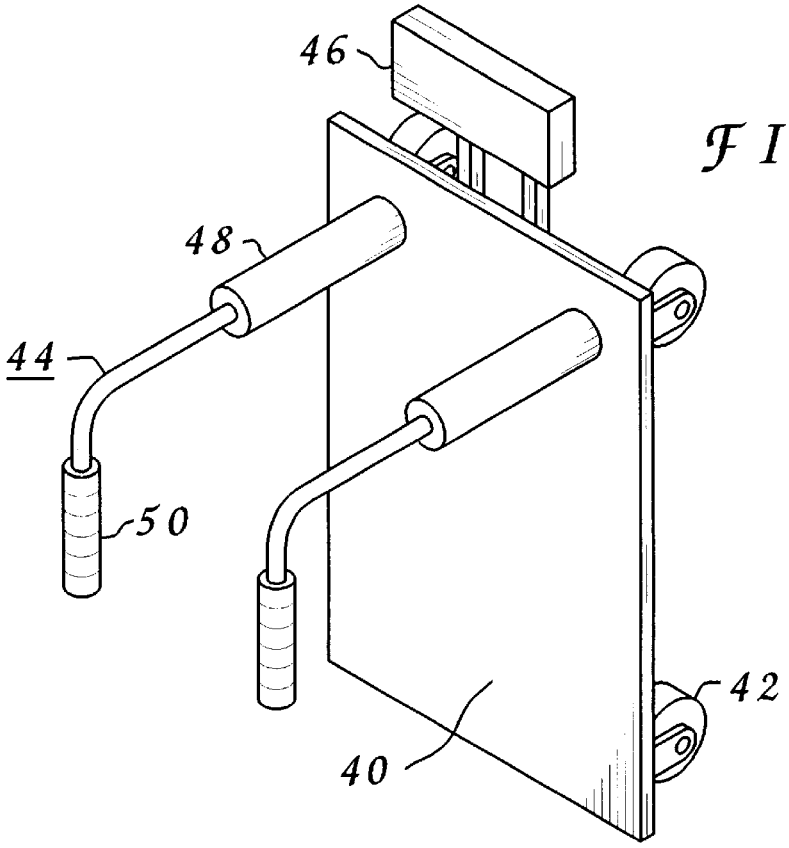
FIG. 5 is a perspective view of another embodiment of an exercise device.
Figure 6:
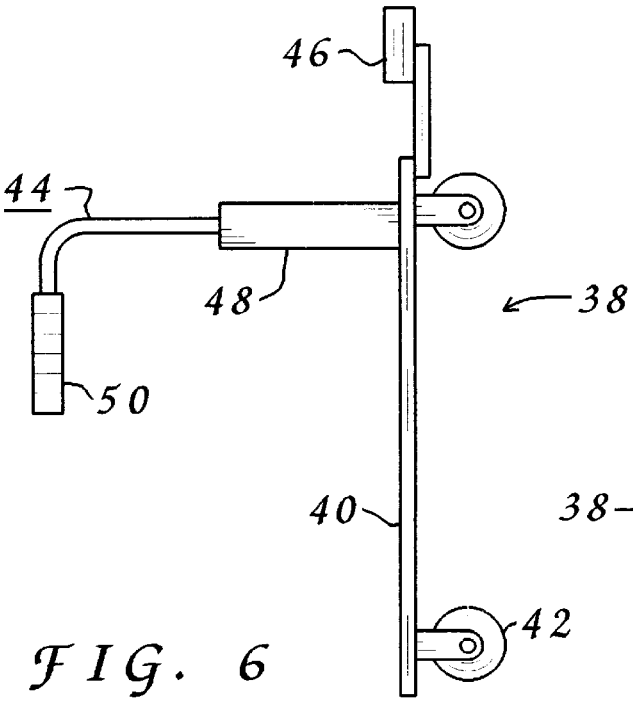
FIG. 6 is a side elevational view of the exercise device shown in FIG. 5.
Figure 7:
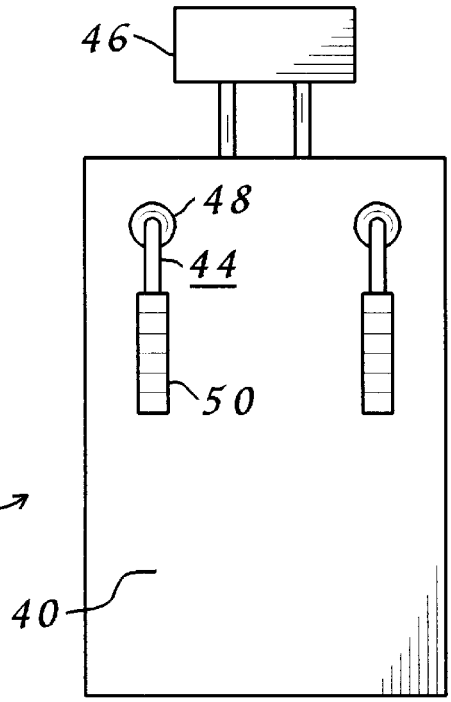
FIG. 7 is a front elevational view of the exercise device shown in FIG. 5 and FIG. 6.

Many different devices having features of the present invention are possible. The following description describes the preferred embodiments of select features of those devices and various combinations thereof. These features may be deployed in various combinations to arrive at various desired working configurations of exercise devices.

Reference is hereafter made to the drawings where like reference numerals refer to like parts throughout the various views.

Exercise devices having features of the present invention will have a back support surface to contact the user, rolling members attached relative to the back support surface to make a gliding contact with a wall surface and a grip member, or members, positioned relative to the back support surface which provide for the user to retain the exercise device while moving to place the exercise device against the wall surface and which provide for the user to retain the exercise device during vertical displacement of the exercise device relative to the wall surface during repetitive performance of a squatting exercise. The squatting exercise involves the user sliding his or her upper body down relative to the wall surface while bending at the waist and the knees and sliding his or her upper body up relative to the wall surface while straightening the waist and the knees.

The back support surface may have various configurations and contours as desired and may have padding positioned thereon for the comfort of the user. The back support surface may be generally parallel to the wall surface or may have an angular offset thereto. A particularly desired embodiment provides for user adjustment of the offset within a predefined range of offset.

Numerous structural elements are conventionally known in the art to provide for a rolling contact with a flat surface and many of these may be employed for the present invention. Examples include wheels, ball socket type rollers and tracked members. Preferably the rolling members will have features which provide for a true tracking along a desired path wherein proper alignment is ensured during the performance of the squatting exercise. Preferably the rolling members will have features which prevent marking of, or other damage to being inflicted to, the wall surface utilized as the planar vertically oriented surface during the performance of the squatting exercise. Such features may involve selection of a construction material, either of a firm hard material or of a flexible resilient material, which resists any depositing of material on a contact surface.

The grip member may be a single element or may be separate elements. The grip member provides for the user to securely hold the exercise device while the back support surface is in contact with the back of the user both prior to placement against the wall surface and during performance of the squatting exercise. Preferably the portions of the grip member which the user grasps will be positioned in front of the user where easy and convenient access is assured. If desired structures may be employed which allow for user adjustment of placement of the portions which the user grasps. Such adjustment of placement may include elevational adjustment from the back support surface, longitudinally adjustment along the back support surface and angular orientation adjustment relative to the back support surface. The grip member may be structures which engage the shoulders of the user for gravity retention thereon. When this arrangement is employed preferably padding will be positioned on the grip member to provide for the comfort of the user.

Many fitness experts believe that the squat exercise is the single most effective exercise that there is. It is possible to target specific parts of the body by utilizing different foot positions and select descent and elevation levels during performance of the squatting exercise. The following general examples give but a few of the possible orientations which the user may utilize. The farther forward from the bearing surface of the back support member the harder the overall exercise becomes. When the feet are spaced further apart the more the upper quadriceps, hamstrings and buttocks are targeted. When the feet are turned out, where the toes have a greater spacing then the heels, a greater emphasis is placed on the outer portions of the thighs. When the user makes a deep decent during the lowering portion of performance of the squatting exercise the gluteus maximus are targeted. When the legs are kept close together the lower front portions of the quadriceps are targeted. When a series of the squatting exercises are performed at a slow rate while making deep descents muscle growth and strength will result. When a series of the squatting exercises are performed at a faster pace with shallower descent, less knee bending, muscle toning and overall cardiovascular enhancement will result.

Without regard for the specific routine utilized performance of squatting type exercises utilizing the fitness glider exercise device will put less stress on the lower back, knees and ankles than that resulting from unassisted performance of the squat type exercise.

FIG. 1 through FIG. 4 depict an exercise device 20 having a back support surface 22, rolling members 24 and grip members 26. Rolling members 24 are designed to make contact with a vertically oriented flat surface, not shown in these views, and roll therealong. Back support surface 22 is offset from the contact plane of rolling members 24 with the vertically oriented flat surface. Grip members 26 have a gripping area 28 therealong which the user, not shown in these views, may readily grip during performance of a squatting exercise. Gripping area 28 has a greater spacing from the contact plane of rolling members 24 than that spacing of back support surface 22 from the contact plane of rolling members 24.

Exercise device 20 is formed of a backing panel 30 having a mechanical resistance device 31 contained therein, a front panel 32 and various piping members 34. Various bolts 36 retain backing panel 30 and front panel 32 about piping members 34.

FIG. 5 through FIG. 8*b* depict an exercise device 38 having a back support surface 40, rolling members 42, grip members 44 and a head rest 46. Grip members 44 each further comprise a shoulder contact portion 48 and a hand contact portion 50.

Figure 8A:
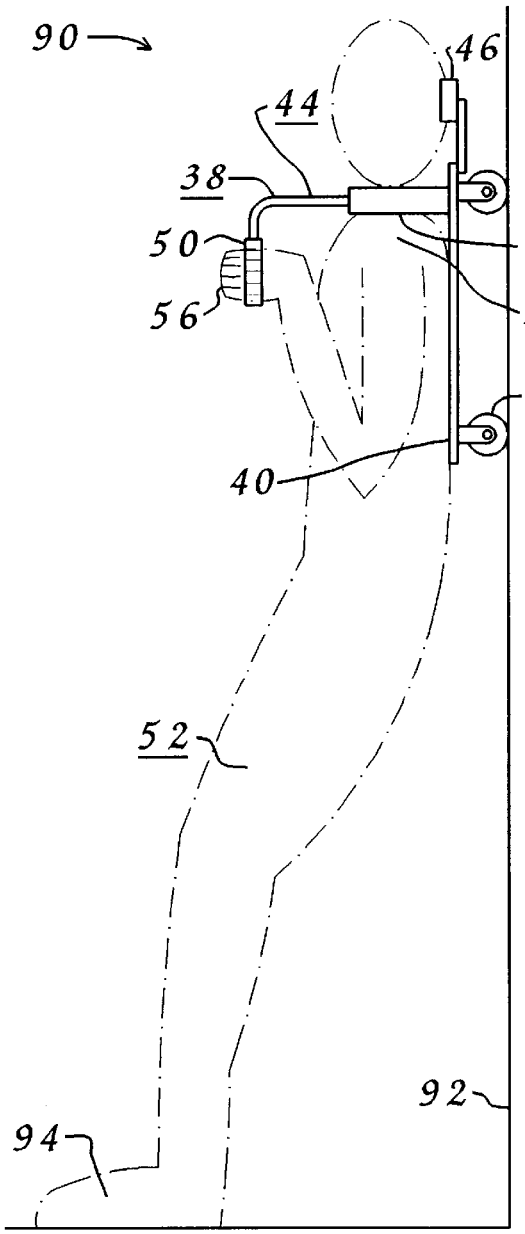
FIG. 8*a* and FIG. 8*b* are side elevational views of the exercise device shown in FIG. 5 through FIG. 7 in alternative positions orientations during performance of a squatting exercise.
Figure 8B:
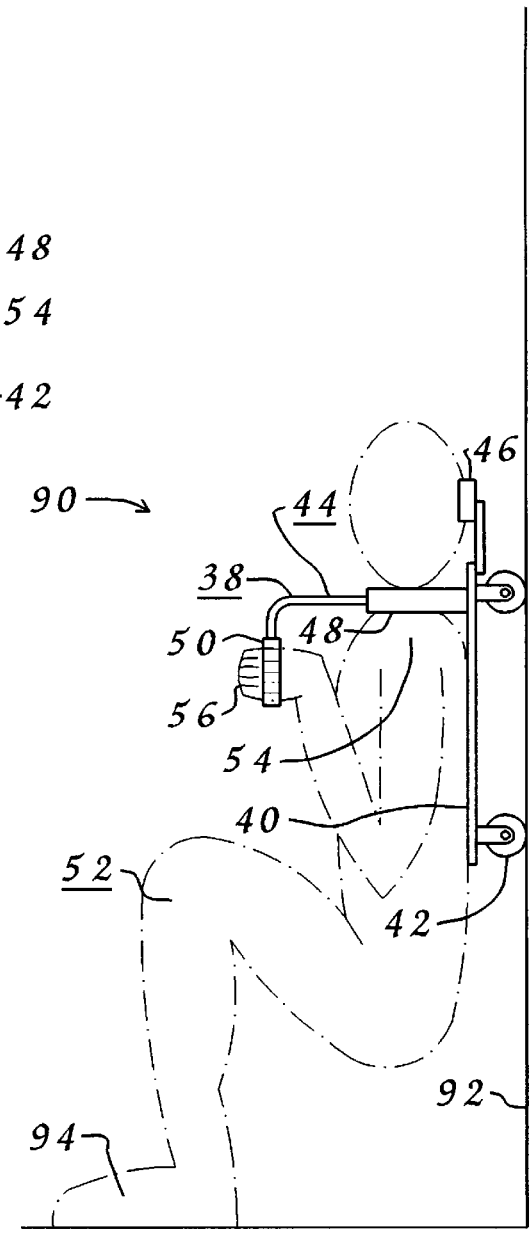

During usage exercise device 38 will make contact with a user 52, see FIG. 8*a* and FIG. 8*b*, at back support surface 40 and someplace along grip members 44. This contact with grip member may involve contact between shoulder contact portion 48 of grip member 44 with a shoulder 54 of user 52 or may involve contact between hand contact portion 50 of grip member 44 with a hand 56 of user 52.

FIG. 9*a* and FIG. 9*b* depict an exercise device 58 having a back support surface 60, rolling members 62, grip members 64 and an angular offset locking member 66. FIG. 9*a* depicts adjustment of angular offset locking member 66 wherein back support surface 60 is generally parallel relative to a bearing plane formed by rolling members 62 and a vertical surface, not shown in these views. FIG. 9*b* depicts adjustment of angular offset locking member 66 wherein back support surface 60 is angularly offset relative to the bearing plane formed by rolling members 62 and the vertical surface. Back support surface 60 is positioned on a first board 68. Rolling members 62 are attached to a second board 70. First board 68 is pivotally attached to second board 70 using a hinge 72. A guide channel 74 of angular offset locking member 66 is anchored to first board 68. A tightening knob 76 of angular offset locking member 66 is secured to second board 70 through a slot 78 in guide channel 74. When tightening knob 76 is loosened an angular offset of back support surface 60 may be adjusted and secured at a desired offset by tightening knob 76. This arrangement provides for adjustment of exercise device 58 to various operational orientations wherein various exercises may be employed. Preferably, opposing angular offset locking members 66 are deployed on opposing sides of back support surface 60. Grip members 64 may be configured in such a way that grip members make contact with a respective portion of the body of the user at the shoulder and/or chest areas without requiring the user to utilized his or her hands to engage exercise device 58.

FIG. 10 depicts an angular offset locking member 80 secured to first board 68 and second board 70. Angular offset locking member 80 further comprises a set plate 82 having a plurality of apertures 84 therethrough, an anchor mount 86 and a set pin 88 slidably attached to anchor mount 86. In usage set pin 88 is retracted beyond set plate 82 and first board 68 is angularly adjusted relative to second board 70 to a desired location corresponding to a marking 83 adjacent an aperture 84 and set pin 88 is positioned through set plate 82 to secure the desired angular offset. Preferably, opposing angular offset locking members 80 are deployed on opposing sides of the back support surface.

Many different exercises may be performed with exercise devices having features of the present invention depending upon the configuration of the respective exercise device and the placement of the body, and particularly the feet, of the user. FIG. 8*a* and FIG. 8*b* depict one example of performance of a squatting exercise 90. During squatting exercise 90 a smooth rolling contact exists between exercise device 38 and a planar vertically oriented surface 92. In this example feet 94 of user 52 are positioned at a comfortable placement from planar vertically oriented surface 92 wherein user 52 may make a full range squatting exercise. Many different positions of feet 94 are possible including spacing from planar vertically oriented surface 92, spacing between feet 94 and angular orientation of feet 94 relative to one another.

Many structures are known in the art to provide for mechanical resistance to displacement in one direction with a release of stored energy for easier displacement in the opposing direction and many of these structures may be utilized with the present invention. Such mechanical resistance may be self contained relative to the exercise device and which provide for storage of energy during movement of the rolling members in one direction with release of the stored energy during movement of the rolling members in the opposing direction. Alternatively, the mechanical resistance may be attached to the exercise device at one end of the mechanical resistance structure and anchored to a detached fixed positioned point, such as the top of a door or a door frame. Examples of this type of mechanical resistance structures include elastic members.

The mechanical resistance may provide for accumulation of resistance during the lowering portion of the squatting exercise and to provide for a reduction of effort by the user during the raising portion of the squatting exercise. Alternatively, the mechanical resistance may be delivered during the raising portion of the squatting exercise to increase the difficulty of the exercise for advanced users.

The mechanical resistance may start at a neutral position where little or no resistance is encountered or may start with significant resistance from a beginning point in the exercise, such as where the user is in a standing positioned.

FIG. 4 depicts mechanical resistance device 31 as conventionally known in the art for floor type exercises. Mechanical resistance device 31 has rolling members 24 each in communication with an engagement gear 96. During movement of rolling members 24 engagement gears 96 cause rotation of a main gear 98. Main gear 98 has attached thereto a first end 100 of a tension member 102. Tension member 102 is a coil spring with a round cross section and is coils loosely around a rotation shaft 104 of main gear 98. A second end 106 of tension member 102 anchors to backing panel 30. During rotation of main gear 98 tension member 102 gathers resistance during rotation of rolling members 24 in a first direction of rotation. This gathered resistance is then releasable during rotation of rolling members 24 in a second direction of rotation. In this example the resistance is stored during downward motion within the squatting exercise and released during upward motion within the squatting exercise. Based upon an initial tension of tension member 102 and a corresponding blockage of further release thereof significant initial resistance may be provided if desired to make for easier performance of the entire squatting exercise.

It is desirable to have the exercise device be readily transportable. This is easily provided for by having the grip members collapsibly mounted or detachably mounted relative to the back support surface.

Figure 11:
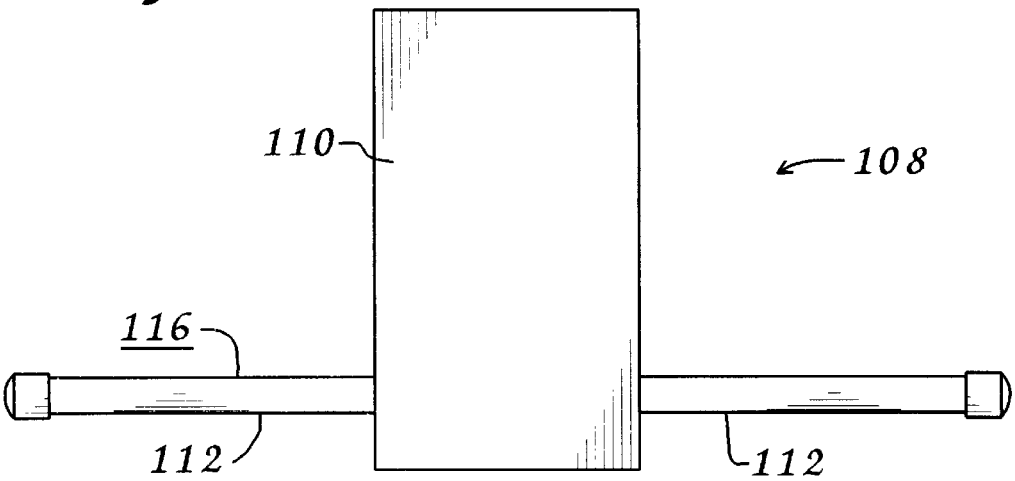
FIG. 11 is a front elevational view of a transportable embodiment of an exercise device in a usage orientation.
Figure 12:
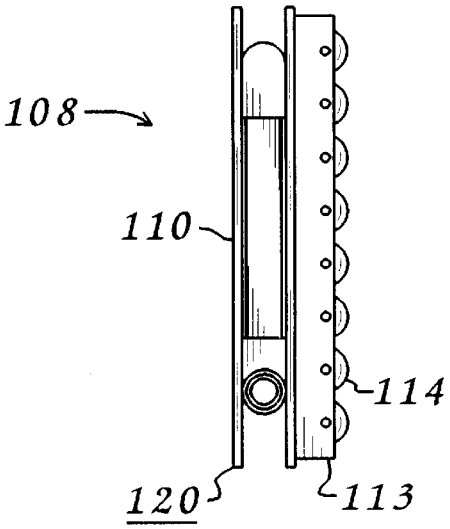
FIG. 12 is a side elevational view of the exercise device shown in FIG. 11 in a transport orientation.
Figure 13:
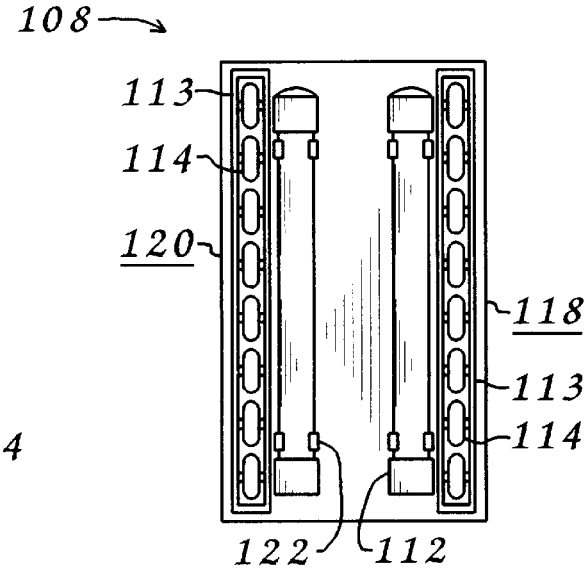
FIG. 13 is a rear elevational view of the exercise device shown in FIG. 11 and FIG. 12 in the transport orientation.

FIG. 11 through FIG. 13 depict an exercise device 108 having a back support surface 110, opposing grip members 112 and opposing sets 113 of rolling members 114. In this embodiment exercise device 108 is transferable between a usage orientation 116, see FIG. 11, and a transport orientation 118, see FIG. 12 and FIG. 13. A support housing 120 has attached thereto sets 113 of rolling members 114 and has positioned thereon back support surface 110. Positioned between sets 113 of rolling members 114 are clamps 122. Grip members 112 securely attach to support housing 120 as conventionally known in the art for such coupling while exercise device 108 is in usage orientation 116. Grip members 112 are retained by clamps 122 while exercise device 108 is in transport orientation 118.

When grip members 112 are positioned at the base of back support surface 110 as depicted in FIG. 11 the user, not shown in these views, would position his or her arms downward with the hands holding an appropriate position on grip members 112.

With respect to the above description then, it is to be realized that the optimum dimensional relationships for the parts of the invention, to include variations in size, material, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An exercise device to support a user at a portion of a back of the user during a performance of a squatting exercise by the user, the performance of the squatting exercise by the user occurring while the back of the user is displaced vertically adjacent to a planar vertically oriented surface, the exercise device comprising:

a) a plurality of rolling members having a bearing plane, the rolling members to contact the planar vertically oriented surface during the performance of the squatting exercise generally at the bearing plane of the rolling members, the rolling members to provide for a smooth rolling contact of the exercise device with the planar vertically oriented surface during the performance of the squatting exercise;

b) a back support surface to contact the portion of the back of the user during the performance of the squatting exercise, the back support surface positioned on the exercise device relative to the rolling members, the back support surface having an average spacing distance from the bearing plane of the rolling members;

c) a grip member for grasping by the user during the squatting exercise, the grip member positioned on the exercise device relative to the back support surface, the grip member having an average spacing distance from the bearing plane of the rolling members and wherein the average spacing distance of the grip member from the bearing plane of the rolling members is significantly greater than the average spacing distance of the back support surface from the bearing plane of the rolling members;

d) mechanical resistance means to provide for a mechanical increase in a resistance to movement from a first operational position relative to the planar vertically orientated surface to a second operational position relative to the planar vertically oriented surface during a winding of a mechanical member and a mechanical decrease in a resistance to movement from the second operational position relative to the planar vertically oriented surface to the first operational position relative to the planar vertically oriented surface during an unwinding of the mechanical member; and wherein the mechanical member of the mechanical resistance means further comprises a coil spring member.

2. The exercise device defined in claim 1 wherein the coil spring member further comprises a round cross section.

3. The exercise device defined in claim 1 wherein the mechanical increase in the resistance from the first operational position to the second operational position occurs during movement from an elevated position relative to the planar vertically oriented surface to a lowered position relative to the planar vertically oriented surface during the performance of the squatting exercise.

4. The exercise device defined in claim 1 wherein the mechanical resistance means further comprises a significant mechanical resistance commencing from initial movement from the first operational position relative to the planar vertically oriented surface during the performance of the squatting exercise.

* * * * *